US012729448B2

(12) United States Patent
Landes et al.

(10) Patent No.: US 12,729,448 B2
(45) Date of Patent: Sep. 8, 2026

(54) GAS DIFFUSION ELECTRODE, AN ELECTROLYSIS SYSTEM, AND A METHOD FOR OPERATING AN ELECTROLYSIS SYSTEM

(71) Applicant: Siemens Energy Global GmbH & Co. KG, Munich (DE)

(72) Inventors: Harald Landes, Ruckersdorf (DE); Christian Reller, Minden (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 1198 days.

(21) Appl. No.: 16/980,954

(22) PCT Filed: Mar. 8, 2019

(86) PCT No.: PCT/EP2019/055839

§ 371 (c)(1),
(2) Date: Sep. 15, 2020

(87) PCT Pub. No.: WO2019/185328

PCT Pub. Date: Oct. 3, 2019

(65) Prior Publication Data

US 2021/0002776 A1 Jan. 7, 2021

(30) Foreign Application Priority Data

Mar. 29, 2018 (DE) ..... 10 2018 204 890.8
Apr. 12, 2018 (DE) ..... 10 2018 205 571.8

(51) Int. Cl.
*C25B 11/031* (2021.01)
*C25B 1/00* (2021.01)
(Continued)

(52) U.S. Cl.
CPC ..... *C25B 11/031* (2021.01); *C25B 1/00* (2013.01); *C25B 9/17* (2021.01); *C25B 11/051* (2021.01); *C25B 11/069* (2021.01)

(58) Field of Classification Search
CPC ..... C25B 11/031–032; C25B 3/26; H01M 4/86–98
See application file for complete search history.

(56) References Cited

U.S. PATENT DOCUMENTS 3,423,247 A * 1/1969 Darland, Jr. ..... H01M 4/86 429/534
3,444,004 A * 5/1969 Smith ..... H01M 4/8828 429/535

(Continued)

FOREIGN PATENT DOCUMENTS

DE 102015215309 A1 2/2017
WO 2016038349 A1 3/2016

OTHER PUBLICATIONS

Zawodzinski et al, "The contact angle between water and the surface of perfluorosulphonic acid membranes", 1993, Journal of Applied Electrochemistry, 23, 86-88. (Year: 1993).*

(Continued)

*Primary Examiner* — Luan V Van
*Assistant Examiner* — Andrew Koltonow
(74) *Attorney, Agent, or Firm* — Wolter Van Dyke Davis, PLLC

(57) ABSTRACT

A gas diffusion electrode having at least two layers, of which a first layer has an electrically conductive fabric, which is embedded at least in part in a hydrophobically acting polymer matrix, and a second layer has an open porosity which has catalytically acting particles and has a thickness between 1 μm and 50 μm.

19 Claims, 2 Drawing Sheets

(51) Int. Cl.

| | |
|---|---|
| ***C25B 9/17*** | (2021.01) |
| ***C25B 11/051*** | (2021.01) |
| ***C25B 11/069*** | (2021.01) |

(56) References Cited

U.S. PATENT DOCUMENTS

| | | | | |
|---|---|---|---|---|
| 3,799,811 | A * | 3/1974 | Sampson | B32B 5/24 429/534 |
| 4,563,261 | A * | 1/1986 | Staab | C25B 11/031 204/290.06 |
| 4,615,954 | A * | 10/1986 | Solomon | H01M 4/9008 429/405 |
| 5,584,976 | A * | 12/1996 | Nishiki | H01M 4/86 429/534 |
| 6,428,722 | B1 * | 8/2002 | Furuya | H01M 4/8807 429/530 |
| 2002/0098407 | A1 * | 7/2002 | Kunisa | H01M 4/8892 429/535 |
| 2011/0139610 | A1 * | 6/2011 | Shirvanian | H01M 4/92 502/100 |
| 2013/0157169 | A1 * | 6/2013 | Madden | H01M 4/8828 429/535 |
| 2016/0017503 | A1 * | 1/2016 | Kaczur | C25B 3/25 205/346 |
| 2016/0211528 | A1 * | 7/2016 | Swiegers | C25B 1/13 |
| 2017/0037522 | A1 | 2/2017 | Kaczur et al. | |
| 2018/0230612 | A1 | 8/2018 | Krause et al. | |

OTHER PUBLICATIONS

Wu et al, "Electrochemical reduction of carbon dioxide: IV dependence of the Faradaic efficiency and current density on the microstructure and thickness of tin electrode", Feb. 13, 2014, Journal of Power Sources, 258, 189-194. (Year: 2014).*

Wloch et al, "Nanoscale Water Contact Angle on Polytetrafluoroethylene Surfaces Characterized by Molecular Dynamics-Atomic Force Microscopy Imaging", Mar. 12, 2018, Langmuir, 34, 4526-4534. (Year: 2018).*

Kutz et al, "Sustainion Imidazolium-Functionalized Polymers for Carbon Dioxide Electrolysis", Dec. 19, 2016, Energy Technology, 5, 929-936. (Year: 2016).*

Endrodi B et al: "Continuous-flow electroreduction of carbon dioxide", Progress in Energy and Combustion Science, Elsevier Science Publishers, Amsterdam, NL, vol. 62, pp. 133-154, XP085135284, ISSN: 0360-1285, DOI: 10.1016/J.PECS.2017.05.005, Figures 3, 6; Table 1; 2017.

Wu Jingjie et al: "Electrochemical reduction of carbon dioxide:IV dependence of the Faradaic efficiency and current density on the microstructure and thickness of tin electrode", Journal of Power Sources, Elsevier SA, CH, vol. 258, pp. 189-194, XP028604611, ISSN: 0378-7753, DOI: 10.1016/J.JPOWSOUR.2014.02.014; the whole document; 2014.

PCT International Search Report and Written Opinion of International Searching Authority mailed Jul. 2, 2019 corresponding to PCT International Application No. PCT/EP2019/055839 filed Mar. 8, 2019.

* cited by examiner

GAS DIFFUSION ELECTRODE, AN ELECTROLYSIS SYSTEM, AND A METHOD FOR OPERATING AN ELECTROLYSIS SYSTEM

CROSS REFERENCE TO RELATED APPLICATIONS

This application is the US National Stage of International Application No. PCT/EP2019/055839 filed 8 Mar. 2019, and claims the benefit thereof. The International Application claims the benefit of German Application No. DE 10 2018 205 571.8 filed 12 Apr. 2018 and German Application No. DE 10 2018 204 890.8 filed 29 Mar. 2018. All of the applications are incorporated by reference herein in their entirety.

FIELD OF INVENTION

The invention relates to a gas diffusion electrode, an electrolysis plant for the conversion of carbon oxide and also a method for operating an electrolysis plant.

BACKGROUND OF INVENTION

To utilize the fluctuating electric power from renewable energy sources, for example wind and photovoltaics, it is possible to synthesize organic materials of value which are obtained from the carbon dioxide-containing offgases of industry and fossil fuel power station processes by means of aqueous CO2 electrolysis. One process step here is to reduce carbon dioxide to carbon monoxide with the aid of electric energy, with the carbon monoxide serving as versatile material of value and as starting material for the further synthesis of organic materials. For this purpose, electrolysis plants in the form of electrolyzers which have a gas diffusion electrode (GDE) as a central component are employed. These gas diffusion electrodes are usually produced on the basis of a silver catalyst bound in a polymer matrix, with a metal mesh, for example, also being introduced into this matrix to effect mechanical stabilization. However, a problem associated with such gas diffusion electrodes is that they have too low a long-term stability, in particular intrusion of electrolyte liquid into the gas diffusion electrode and precipitation of salts from the electrolyte solution occur. This is referred to as salting of the gas diffusion electrode, which makes the latter unusable in the long term.

SUMMARY OF INVENTION

It is an object of the invention to provide a gas diffusion electrode and also an electrolysis plant having a gas diffusion electrode and a method for operating an electrolysis plant which has a longer life than is the case for the conventional construction.

The object is achieved by a gas diffusion electrode as claimed and also by an electrolysis plant as claimed and the method for operating an electrolysis plant as claimed.

The gas diffusion electrode as claimed has at least two layers of which a first layer has an electrically conductive woven fabric which is at least partially embedded in a hydrophobic polymer matrix. Furthermore, the gas diffusion electrode has a second layer which has an open porosity in which catalytically active particles are present and has a thickness in the range from 1 μm to 50 μm.

The first layer having the electrically conductive woven fabric serves essentially to stabilize the gas diffusion electrode mechanically and to effect electrical contacting. This is a feature which is already known for the GDEs of the prior art. However, as a difference from the prior art, this woven fabric is surrounded by a hydrophobic polymer matrix. Hydrophobic materials are characterized in that they have a contact angle with water or the adjoining liquid electrolyte which is greater than 70°, advantageously greater than 90°. This prevents intrusion of a liquid electrolyte into the first layer of the GDE. This in turn results in "salting" by precipitation of salts from the electrolyte in the matrix of the GDE being prevented. This is additionally prevented by the presence of a second layer in which catalytically active particles, in particular or for example silver particles, are present in an open porosity of the second layer. These catalytically active particles, in particular silver particles, are, in contrast to the matrix of the first layer, hydrophilic and draw in the liquid electrolyte and lead it to an interface between the first layer and the second layer. The actual chemical reaction of a starting material occurs at or in the vicinity of this interface, with the electrons for conversion of the starting material being made available by the electrically conductive woven fabric which extends to the interface between the two layers. Further intrusion of the liquid electrolyte beyond this interface into the first, hydrophobic layer is avoided.

It has been found to be particularly advantageous for the woven fabric to consist of or comprise silver-containing, titanium-containing or carbon-containing fibers. When the woven fabric is protected against wetting by the electrolyte by the polymer matrix except for the contact points to the second layer, the fabric can also comprise nickel. Particular advantage is given to a woven fabric composed of silver fibers. A suitable matrix material for the polymer matrix of the first layer is polytetrafluoroethylene. This is sufficiently hydrophobic and is suitable for enclosing the woven fabric very well. Such an enclosure of the woven fabric by the polymer matrix is advantageous because it results in the intrinsically catalytically and hydrophilically active surface of the silver or other possible fiber materials not coming into contact with the liquid electrolyte. As mentioned above, it is undesirable for a catalytic reaction between the electrolyte and the starting material to take place in the first layer, since this could bring about salting of the first layer.

The expression polymer matrix does not refer to a closed dense matrix but instead, as mentioned above, refers to a porous matrix which allows gaseous starting materials to diffuse through this polymer matrix and get to an interface between the first layer and the second layer for reactive conversion.

The first layer of GDE advantageously has a thickness in the range from 50 μm to 1000 μm. The thickness of the first layer is essentially determined by the thickness of the individual fibers of the woven fabric. Fibers having a diameter of 100 μm are quite usual, and the mesh opening is usually 0.3 mm. Greater fiber thicknesses and thus greater layer thicknesses of the first layer are quite possible: they give greater stability to the GDE but lead to the starting materials, in particular gaseous starting materials, having to diffuse through a thicker layer, which in turn decreases the electrochemical reaction between the first layer and the second layer. A balance between the wire thickness or fiber thickness of the woven fabric and the reactivity of the GDE thus has to be achieved in selecting the thickness of the first layer. In general, the thickness of the first layer is in the range from 100 μm to 400 μm.

Furthermore, it is advantageous for the polymer matrix of the first layer to have a porosity in which 95% of the pores have a diameter in the range from 0.1 μm to 2 μm, advantageously from 0.6 μm to 0.9 μm. Pores of this size still allow gaseous starting materials to diffuse readily but, owing to their hydrophobic character, do not allow any, or barely any, liquid electrolyte to intrude, even when the electrolyte has an overpressure of 0.2 bar relative to the gas phase in the first layer, as can occur in relatively large cells and stacks.

The catalytically active particles of the second layer have a diameter which is in the range from 0.05 μm to 1 μm, advantageously from 0.1 μm to 0.5 μm. Such fine particles, in particular silver particles, in turn have a large catalytic surface area at which the desired reaction can take place. The catalytically active particles are, in particular, silver particles which firstly have a hydrophilic surface which promotes the drawing-in of the liquid electrolyte. Secondly, the surface of the silver particles is particularly catalytically active for many desired reactions, for example for the conversion of carbon dioxide into carbon monoxide, with the interfering reduction of water to hydrogen being suppressed. Furthermore, it is advantageous for the catalytically active particles to be mixed with likewise hydrophilic binders, so that a targeted porosity can be set and particular bonding between the catalytically active particles occurs. It is advantageous here for the contact angle of these hydrophilic binders to be less than 90°.

Furthermore, it is also advantageous in this composition for 95% of the pores of the second layer to have a diameter which is in the range from 0.1 μm to 5 μm or advantageously from 0.1 μm to 1 μm. In measuring the porosity in all the layers described, recourse is made to an image analysis method. Here, a cross section or plan view is imaged microscopically and the pore abundance and the diameter thereof at the largest position of the diameter is evaluated.

A further aspect of the invention is an electrolysis plant for the electrolytic conversion of carbon dioxide having a gas diffusion electrode as claimed. Such an electrolysis plant has a gas space and an electrolyte chamber. The gas diffusion electrode is installed between the gas space and the electrolyte chamber and separates these from one another at least in regions. Here, the second layer of the GDE is arranged so as to face the electrolyte chamber, while the first layer is in contact with the gas space. With this construction, the above-described action of the gas diffusion electrode can be implemented industrially. Furthermore, it is advantageous for a contact web to contact the gas diffusion electrode electronically and thus be in direct contact with uncoated parts of the woven fabric.

A further aspect of the invention is a method for operating an electrolysis plant, wherein a carbon dioxide-containing starting material is introduced into a gas space where the starting material is conveyed to a gas diffusion electrode and diffuses through a first layer of the gas diffusion electrode. Here, it arrives at an interface of the first layer and a second layer of the gas diffusion electrode and is chemically converted there. Here, the second layer is a porous layer which is impregnated by a liquid electrolyte.

As regards the method and the electrolysis plant, these have the same modes of action and advantages described above for the gas diffusion electrode. This applies particularly to the abovementioned configuration of the first and second layers, with the first layer being hydrophobic and the second layer advantageously being hydrophilic and also containing catalytically active particles. The desired reaction, in particular the reduction of carbon dioxide to carbon monoxide, occurs at an interface between the hydrophilic layer and the hydrophobic layer.

BRIEF DESCRIPTION OF THE DRAWINGS

Further embodiments and further features of the invention will be illustrated with the aid of the following figures, which show.

DETAILED DESCRIPTION OF INVENTION

Figure 1:
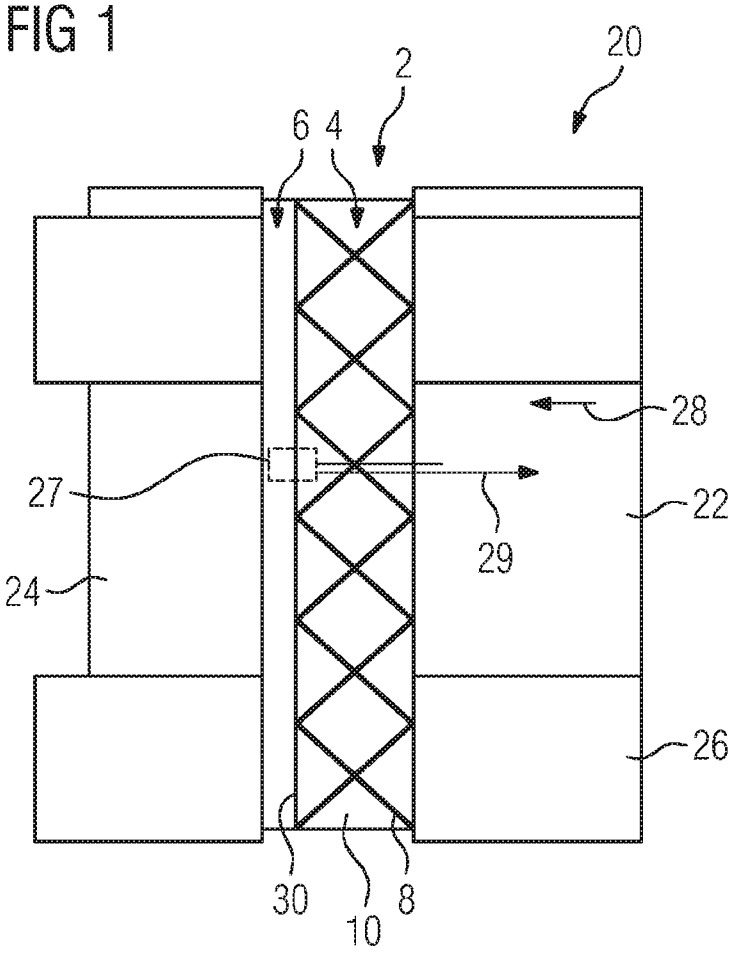
FIG. 1 a schematic depiction of the arrangement of a gas diffusion electrode in an electrolysis plant having a gas space and electrolyte chamber, FIG. 2 an enlarged schematic depiction of the microstructure of the gas diffusion electrode in a boundary region between a first layer and a second layer and FIG. 3 a schematic depiction of the determination of the contact angle.

FIG. 1 shows a schematic depiction of a part of an electrolysis plant 20. An electrolysis plant 20 can also be referred to as an electrolyzer, with carbon dioxide being introduced as starting material and carbon monoxide being formed as product in this case. The electrolysis plant 20 has a gas space 22 and an electrolyte chamber 24. The starting gas carbon dioxide is brought into the gas space 22 via a starting material feed device, which is not shown here, and is conveyed through the gas space 22 to a gas diffusion electrode (GDE) 2. The gas diffusion electrode 2 comprises essentially two layers, namely a first layer 4 and a second layer 6. The first layer 4 is characterized in that it assumes a supporting function for the entire GDE 2, and a woven fabric 8, which consists, for example, of silver threads, is embedded therein. The woven fabric 8 is in turn surrounded by a polymer matrix 10 which has, however, a porous structure so that starting materials 28 in the form of carbon dioxide can diffuse in gaseous form through the first layer 4 to an interface 30 of the GDE 2. The interface 30 marks the boundary between the first layer 4 and the second layer 6. The second layer 6 has a functional character compared to the first layer 4. It is characterized in that it likewise has a porosity and catalytically active particles 9 in the form of silver particles 9 are present on the surface of the pores. Here too, the porosity is open but is infiltrated with a liquid electrolyte 32, which liquid electrolyte 32 is present, in particular, in the electrolyte space 24. Furthermore, contacting webs 26 which adjoin and are physically fitted to the GDE 2 and press the latter against a counter-web 27 and through which the electric current is conducted to the woven fabric 8 and thus into the gas diffusion electrode 2 are provided.

Figure 2:
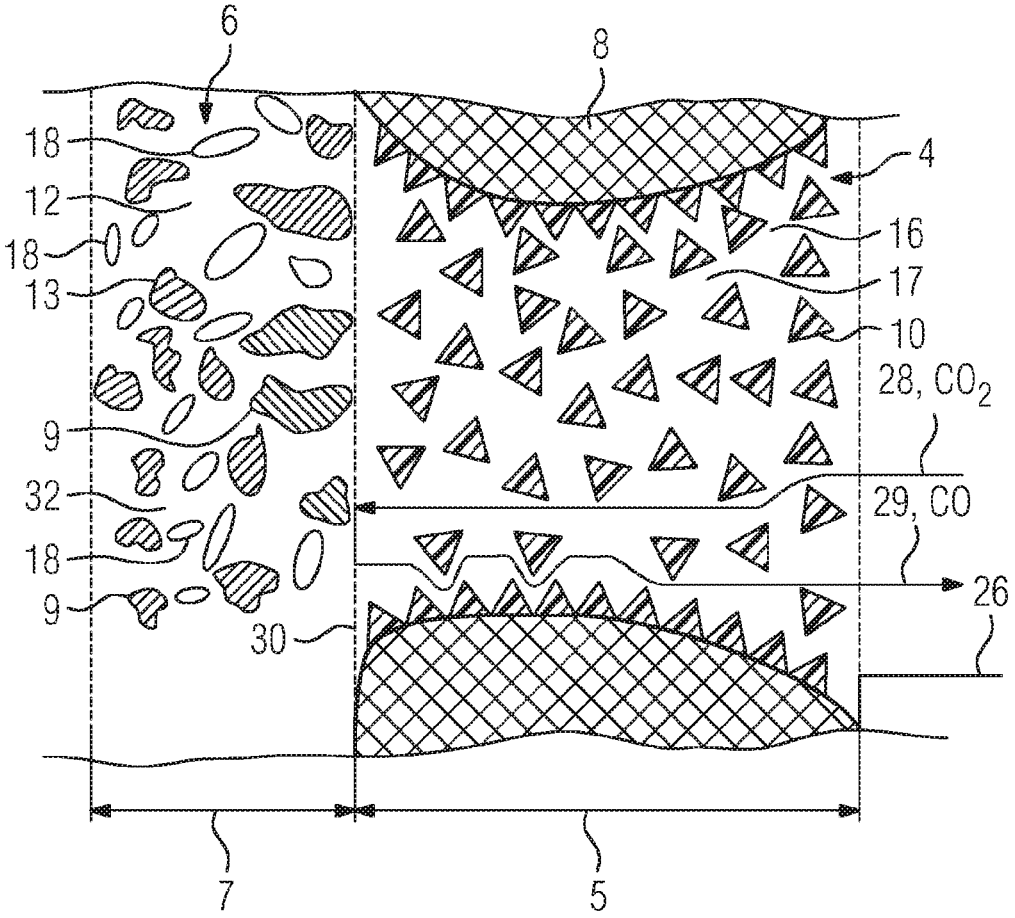

FIG. 2 shows an enlarged schematic part of the boundary region between the first layer 4 and the second layer 6, and is intended to schematically illustrate the microstructure of the GDE 2. This depiction is not true to scale: in particular, the second layer is shown comparatively densely. The first layer 4 with the woven fabric 8 is shown at the right-hand side of FIG. 2, while the second layer 6 can be seen on the left-hand side. The two layers 4, 6 adjoin at the interface 30. The part depicted in FIG. 2 likewise shows part of two fibers of the woven fabric 8 on the right-hand side, with the fibers being silver fibers in this case. The lower fiber of the woven fabric 8 is physically fitted to the contact web 26. Via this, electric current is introduced into the woven fabric 8 and is thus available to the interface 30 and serves to conduct electrons into the GDE 2. It is advantageous for the woven fabric 8 to be protected by an inert matrix or coating. This is, in this embodiment, the polymer matrix 10; the particles of the polymer matrix 10 are depicted here as triangles by way of example and to enable them to be distinguished more readily. In principle, a material other than that used for the porous matrix between the individual fibers of the woven fabric 8 can also be used for coating the woven fabric 8.

However, it is important that the matrix 10 has an open porosity 16 with individual pores 17, so that the starting material 28, i.e. the carbon dioxide, can diffuse through the first layer 4 to the interface 30. This diffusion path is indicated by the arrow 28 next to which $CO_2$ has been written. It is also important that the material of the polymer matrix 10 is a hydrophobic material in order to prevent liquid electrolyte 32 from passing through the interface 30 into the first layer 4 of the GDE 2. This prevents an electrochemical reaction from taking place in the first layer 4, which would, in the case of the reaction equations which apply for conversion of the carbon dioxide into carbon monoxide in conjunction with the electrolyte, lead to salting of the GDE 2 in the important regions of the first layer 4.

Figure 3:
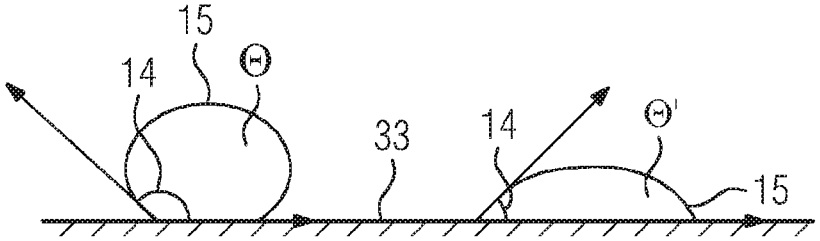

For the present purposes, hydrophobic means that the capillary forces which act on the liquid electrolyte 32 at the interfaces with the particles of the matrix 10 are sufficient to prevent this liquid electrolyte from intruding into the layer 4. It is usually assumed that a material surface 33 has hydrophobic properties when the contact angle, which is schematically shown in FIG. 3, is greater than 90°. However, the contact angle is advantageously >95°. This is shown in the left-hand half of the depiction in FIG. 3. Furthermore, it should be remarked that it is advantageous for the matrix 10 in the first layer 4 to be configured so that it envelopes the fibers of the woven fabric 8 as protective layer, so that even when silver threads are used for the woven fabric 8 no catalytic effect between the surface of the woven fabric 8 and the electrolyte or the carbon dioxide as starting material 28 can occur. For this reason, the triangular matrix parts of the matrix 10 are here shown schematically as representing a protective surface layer on the fibers of the woven fabric 8. However, there can in principle also be a separate coating for the woven fabric 8 which is different from the remaining matrix 10 in respect of the material. In principle, the layer on the silver fibers can also be porous as long as the pore radius is small enough to prevent wetting of the silver fibers with electrolyte in conjunction with the hydrophobic property of the matrix material.

Two important properties of the first layer 4 are thus the supporting function of the woven fabric 8 and also the fact that it is very hydrophobic and very unreactive. The second layer 6 which is generally applied to the first layer 4 by means of a further coating process is quite different therefrom. This layer comprises, in particular, catalytically active particles 9 which are, in particular, in the form of silver particles. These particles 9 can advantageously also be provided with a binder, which here is a hydrophilic binder 18 shown schematically as oval particles in FIG. 2. The surface structure of this hydrophilic binder 18 is characterized in that it displays very good wetting by the liquid electrolyte solution 32, so that the layer 6 can be infiltrated by the electrolyte 32 even when an overpressure in the range of 0.2 bar prevails on the gas side. This is achieved, in particular, when the surface of the hydrophilic binder has a surface tension which leads to the contact angle relative to water or a water droplet 15 or relative to the liquid electrolyte as shown on the right-hand side of FIG. 3 being less than 85°. These binders 18 have, as the name suggests, a bonding action between the individually catalytically active particles 9 and are, depending on the structure and nature of the particles 9, optionally however advantageous for production of the layer 6.

A targeted porosity is set both in the layer 4 and in the layer 6, so that the gas molecules can diffuse through the first layer 4 and the liquid electrolyte 32 can infiltrate into the second layer 6. It has been found to be advantageous here for the pore structure of the first layer 4 to be configured so that 95% of the pores have a diameter in the range from 0.6 μm to 0.9 μm. From a processing engineering point of view, it is not always possible to set such a precise pore structure without an increased engineering outlay. For this reason, larger pores up to 2 μm and also smaller pores down to 0.1 μm are also quite acceptable to a minor extent. The layer thickness of the first layer 4 is determined, in particular, by the diameter of the fibers of the woven fabric 8. It is usually in the range from 100 μm to 500 μm. Thicker layers and thus also thicker fibers of the woven fabric 8 would have a better load-bearing capability but would also result in a longer diffusion path of the gas carbon dioxide and the product 29, CO, through the first layer 4. This would possibly have an adverse effect on the efficiency and the selectivity of the GDE 2 for CO production. The second layer 6 can be made significantly thinner than the first layer 4; the second layer 6 is generally ultimately applied to the load-bearing first layer 4 by means of a particular coating process. From the purely chemical processes which proceed, the second layer 6 could be very thin; strictly speaking, one layer of catalytically active particles 9 would be sufficient. From a process engineering point of view, somewhat greater layer thicknesses are obtained, particularly when using binders 18, while the layer thickness 5 of the first layer 4 is, as mentioned above, in the range from 100 μm to 500 μm, so the layer thickness 7 of the second layer 6 is in the range from 5 μm to 50 μm. Here, each individual particle 9 of the second layer 6 has a diameter which is in the range from 0.5 μm to 3 μm, very particularly advantageously from 0.1 μm to 0.5 μm. As regards the accuracy of these values, what has been said above in respect of the first layer applies; these particle sizes are advantageously restricted so that process irregularities up to a certain extent are not damaging. The same also applies to the porosity of the second layer 6, with 95% of the pores also being in the range from 0.1 μm to 5 μm here, advantageously from 0.1 μm to 1 μm. Hollow particles 9, which are not depicted here and have an inner hollow space which is accessible from the outside and has this pore size are also advantageous. At larger external dimensions, the pores between particles are necessarily also larger and are then no longer suitable for holding the electrolyte against a gas pressure present in the pore.

The conversion of the starting material, generally carbon dioxide 28 into the product carbon monoxide 29, then proceeds at the interface 30 or in the vicinity of from 2 to 3 particle sizes into the respective layer 4 or 6. For this purpose, the following reaction equations advantageously or generally proceed:

$$2CO_2+H_2O+2e^{-}CO+2HCO_3^{-} \qquad \text{Equation 1}$$

$$CO_2+H_2O+2e^{-}CO+2OH^{-} \qquad \text{Equation 2}$$

The electrons required for the reaction equations are supplied via the contact web 26 and the woven fabric 8 to the interface 30. The water concerned is present in a large excess in the electrolyte which penetrates through the second layer 6 to the interface 30. The carbon dioxide is supplied along the illustrated path 28 in FIG. 2, and the carbon monoxide is discharged along the same route through the first layer 4.

The hydrogencarbonate ions or the hydroxide ions are returned in aqueous solution through the layer 6 into the liquid electrolyte and this is replaced by a volume flow, so that a constant concentration is present in each case. Due to the second layer being thin, the transport of all electrolyte components is favored, so that precipitation of hydrogencarbonate is countered. The hydrophobic effect of the matrix 10 in the first layer 4 prevents the electrolyte 32 from getting into the first layer 4 and salts precipitating there after the reaction.

The thickness of the second layer is comparatively small at from 1 μm to 50 μm. This ensures that a sufficient electronic conductivity is available within the catalyst layer in order to ensure supply to the GDE within the mesh openings of the conductive mesh 8. On the other hand, there is sufficient catalytically active surface area of the particles 9 available within the range of the diffusing and dissolved carbon dioxide in order to carry out a current density in the desired form for reduction of the carbon dioxide. The second layer 6 can consequently be in principle made of few monolayers of particles 9 having a diameter of 0.1 μm. Particles 9, in particular silver particles having a diameter of about 1 μm, are also in the region of this, which leads to successful catalysis but is not quite as suitable. However, essentially only the surfaces within a region from the interface into the layer 6 which is in the order of a diffusion length of the dissolved carbon dioxide, i.e. in the range from 0.1 to 1 μm, are electrochemically active. The regions of the second layer 6 which extend further into the electrolyte space contribute only insignificantly to the reduction of CO2 compared to those regions of the layer 6 which are close to the interface 30. The evolution of hydrogen is also possible to only a small extent, if at all, because of a low decrease in voltage in the electrolyte of the GDE 2 since virtually no concentration gradient is established in the porous second layer 6 over this small distance.

The fact that the thickness of the second layer 6 can nevertheless be larger than the abovementioned few particle layers is due to an electrical trace resistance present in the layer 6 having to be low enough to ensure supply of electronic current between the individual contact webs 26.

Furthermore, it has to be ensured that the pore diameter in the second layer 6 in the vicinity of the interface 30 is actually smaller than the above-described upper limit of 1 μm. The pores advantageously have a diameter of only from 0.1 μm to 0.5 μm, so that it is ensured that the hydrophilic surface of the catalytically active particles 9 of these pores 13 are filled with electrolyte 32, which leads to a diffusion barrier for the carbon dioxide. In this way, a stable gas-electrolyte interface is created at the boundary layer 30, which has to be stable over considerable pressure differences of at least 0.2 bar because of the hydrophobic pore structure in the first layer 4. The catalytically active particles 9 should therefore accordingly be anchored, advantageously by means of an additional binder, on the hydrophobic structure of the first layer 4 at the interface 30. It is in principle advantageous for the pore systems both in the first layer 4 which has a supporting function, and the second layer 6, which has a catalytic function, to have a very high porosity. It has been found that porosities above 25% are well suited to allowing firstly the gas transport of carbon dioxide and carbon monoxide through the first layer 4 and secondly the infiltration of the second layer 6 by the liquid electrolyte 32 to occur. Compared to conventional gas diffusion electrodes, the path which has to be covered by the liquid electrolyte 32 into the gas diffusion electrode 2 is here shortened, while the path 28 which the carbon dioxide has to cover through the first layer 4 is not appreciably increased, as a result of which the polarization of the above-described gas diffusion electrode 2 decreases compared to conventional GDEs.

A working example of the production of a gas diffusion electrode 2 as described above will now be given below. A layer of Dyneon TF 2021 is sieved onto a woven silver fabric 8 having a wire diameter of 180 μm and a mesh opening of 250 μm with the aid of 500 μm thick templates (having an opening of 60 mm×120 mm) and subsequently struck off by means of a doctor blade. The layer is rolled with a two-roll calender having a roller gap of 0.3 μm, so that the peaks of the wire mesh project from the membrane. In a further step, a 1 μm-20 μm thick second layer 6, which serves a catalyst layer, of silver nanoparticles having a primary particle diameter of 0.1 μm is sprayed onto the rear side with the aid of an air brush. The particle suspension is produced as follows: 60 mg of silver nanoparticles (purity>99.9%) and 30 mg of a hydrophilic binder (anion-exchange ionomer) are dispersed in 3 ml of n-propanol in an ultrasonic bath for 10-15 minutes. A loading of from 0.5 mg to 3 mg of catalyst/$cm^2$ is sought. The electrode is dried under a continuous stream of argon for 12 hours. Electrical contacting of the nanoparticles is effected by percolation or via the projecting tips of the woven silver fabric 8. The electrode has a trace resistance of 0.001Ω and can advantageously be contacted from the gas side.

A particular advantage of this electrode structure is that the site of the reaction at the interface between first and second layers is fixed within certain limits independently of the pressure difference between gas side and liquid side. This is ensured by the pressure which is necessary to press the electrolyte out from the advantageously hydrophilic second layer being in the region of advantageously more than 0.2 bar and conversely an overpressure of this magnitude from the electrolyte side not being sufficient to allow the electrolyte to penetrate into the first layer. This creates very suitable operating conditions in the reaction zone without the pressure between gas side and electrolyte side having to be set carefully. The GDE described is robust against pressure fluctuations as occur due to weight in relatively large cells and cell stacks or else during flow through the cells in operation. In a conventionally constructed GDE, which consists of a single layer, the penetration depth of the electrolyte is locally different and depends on the pressure difference in the mbar range. Accordingly, the pores filled with electrolyte or gas have different lengths to the site of the reaction and there are therefore places at which the undesirable reduction of water is favored.

The invention claimed is:

1. A gas diffusion electrode comprising:

at least two layers of which a first layer comprises an electrically conductive woven fabric which is at least partially embedded in a hydrophobic polymer matrix and a second layer that is directly applied to the first layer, that comprises an open porosity in which catalytically active particles are present, that comprises a hydrophilic anion exchange monomer, and which has a thickness in the range from 1 μm to 50 μm;

wherein the catalytically active particles of the second layer have a diameter which is in the range from 0.05 μm to 1 μm;

wherein a first side of the electrically conductive woven fabric is configured to establish electrical communication with a contact web disposed adjacent the first layer;

wherein a second side of the electrically conductive woven fabric establishes electrically conductive contact points with the second layer;

wherein the electrically conductive woven fabric comprises a middle region that connects the first side to the second side, and wherein the middle region is electrically insulated in a manner effective to prevent direct electrical communication between the middle region and fluid in the first layer; and wherein the middle region is coated by a coating comprising material that is different than a material of the hydrophobic polymer matrix.

2. The gas diffusion electrode as claimed in claim 1, wherein the electrically conductive woven fabric comprises a silver fiber.

3. The gas diffusion electrode as claimed in claim 1, wherein the hydrophobic polymer matrix has a contact angle with water of more than 90°.

4. The gas diffusion electrode as claimed in claim 1, wherein the first layer has a thickness in the range from 50 μm to 1000 μm.

5. The gas diffusion electrode as claimed in claim 1, wherein the hydrophobic polymer matrix has a porosity and wherein 95% of pores in the hydrophobic polymer matrix have a diameter which is in the range from 0.1 μm to 2 μm.

6. The gas diffusion electrode as claimed in claim 1, wherein the second layer comprises silver particles as the catalytically active particles.

7. The gas diffusion electrode as claimed in claim 1, wherein at least 95% of pores of the second layer have a diameter which is in the range from 0.1 μm to 5 μm.

8. An electrolysis plant for electrolytic conversion of carbon dioxide, comprising:

a gas diffusion electrode as claimed in claim 1.

9. The electrolysis plant as claimed in claim 8, wherein the electrolysis plant has a gas space and an electrolyte chamber, where the second layer of the gas diffusion electrode is arranged so as to face the electrolyte chamber.

10. The electrolysis plant as claimed in claim 8, further comprising the contact web.

11. A method for operating an electrolysis plant, comprising:

introducing a carbon dioxide-containing a starting material into a gas space, conveying the starting material to the gas diffusion electrode of claim 1, wherein the starting material diffuses through a first layer of the gas diffusion electrode, after which the starting material arrives at an interface of the first layer with a second layer of the gas diffusion electrode and is reduced there, where the second layer is a porous layer which is impregnated with a liquid electrolyte.

12. The gas diffusion electrode as claimed in claim 4, wherein the first layer has a thickness in the range from 100 μm to 400 μm.

13. The gas diffusion electrode as claimed in claim 5, wherein 95% of the pores have a diameter which is in the range from 0.6 μm to 0.9 μm.

14. The gas diffusion electrode as claimed in claim 1, wherein the catalytically active particles of the second layer have a diameter which is in the range from 0.1 μm to 0.5 μm.

15. The gas diffusion electrode as claimed in claim 7, wherein at least 95% of the pores of the second layer have a diameter which is in the range from 0.1 μm to 1 μm.

16. The gas diffusion electrode as claimed in claim 15, wherein the gas diffusion electrode defines an interface between the first layer and the second layer; and wherein in a region that is within the second layer and local to the interface, the pores of the second layer comprises a smaller diameter than the pores of the second layer that are further from the interface.

17. The gas diffusion electrode as claimed in claim 16, wherein in the region that is within the second layer and local to the interface, the diameter of the pores of the second layer is from 0.1 μm to 0.5 μm.

18. The gas diffusion electrode as claimed in claim 1, wherein the gas diffusion electrode defines an interface between the first layer and the second layer;

wherein the second layer comprises an additional binder; and wherein the additional binder anchors the catalytically active particles on the hydrophobic polymer matrix of the first layer at the interface.

19. The gas diffusion electrode as claimed in claim 1, wherein both the first layer and the second layer comprise a respective porosity above 25%.

* * * * *